US005219109A

United States Patent [19]

Shirono

[11] Patent Number: 5,219,109

[45] Date of Patent: Jun. 15, 1993

[54] LEVEL CONTROL METHOD FOR SPLICED STRIP MATERIALS HAVING DIFFERENT UNIT WEIGHTS

[75] Inventor: Hiroshi Shirono, Habikino, Japan

[73] Assignee: Chugai Ro Co., Ltd., Osaka, Japan

[21] Appl. No.: 765,039

[22] Filed: Sep. 24, 1991

[30] Foreign Application Priority Data

Sep. 29, 1990 [JP] Japan ..... 2-260869

[51] Int. Cl.[5] ..... B65H 23/18

[52] U.S. Cl. ..... 226/1; 226/4; 226/24; 226/111; 226/195; 34/52; 34/155

[58] Field of Search ..... 226/1, 2, 4, 10, 24–26, 226/108, 111, 118, 195; 34/52, 155, 156, 25; 72/10; 198/810; 177/25.14

[56] References Cited

U.S. PATENT DOCUMENTS 3,230,634 1/1966 Sachs ..... 34/52
4,561,581 12/1985 Kelly ..... 226/24 X
4,799,558 1/1989 Griffen ..... 177/25.14
4,898,094 2/1990 Doumoto et al. ..... 226/4 X

FOREIGN PATENT DOCUMENTS 59-69337 4/1984 Japan .
2-41712 2/1990 Japan .
0864419 4/1961 United Kingdom ..... 226/26

*Primary Examiner*—Daniel P. Stodola
*Assistant Examiner*—Paul T. Bowen
*Attorney, Agent, or Firm*—Wenderoth, Lind & Ponack

[57] ABSTRACT

In a level control method of controlling levels of a series of mutually joined materials when the materials pass through a catenary zone, whenever the joint travels a given length in the catenary zone, a plurality of optimum catenary curves are calculated with the position of the joint in the catenary zone as a parameter. Based upon a result of the calculation so obtained, a relationship indicative of the level of a material at the location of a catenary sensor is then calculated as a function of the position of the joint in the catenary zone. At this moment, the catenary sensor is used to detect the level of the material. Finally, the level of the material at the location of the catenary sensor is controlled with a value indicated by the above relationship being used as a target value. As a result, even when a joint between two adjoining materials having different unit weights passes through the catenary zone, the materials can travel in the catenary zone while the level is appropriately maintained.

6 Claims, 4 Drawing Sheets

LEVEL CONTROL METHOD FOR SPLICED STRIP MATERIALS HAVING DIFFERENT UNIT WEIGHTS

BACKGROUND OF THE INVENTION

1. Field of the Invention

The present invention relates to a level control method particularly useful in applications where a joint between two mutually joined materials having different sectional areas and/or specific gravities, i.e., different unit weights passes through a catenary zone, for example, in a catenary oven.

2. Description of the Prior Art

FIG. 1 schematically depicts an apparatus having a catenary oven 14 and employing a conventional level control method of controlling the level of strips therein. This apparatus is provided with a pair of inlet bridle rolls 12 and a coater 13 on the upstream side of the catenary oven 14 and with a cooler 17 and a pair of outlet bridle rolls 18 on the downstream side of the catenary oven 14 in the direction of travel of a strip 11 to be treated. The catenary oven 14 accommodates a plurality of upper and lower nozzles 15 and 16. The strip 11 travels along the inlet bridle rolls 12 and the coater 13 and is introduced into the catenary oven 14, in which the strip 11 travels between the upper and lower nozzles 15 and 16. Thereafter, the strip 11 passes through the cooler 17 and is conveyed along the outlet bridle rolls 18.

Each of the bridle rolls 12 and 18 is coupled to a reduction unit 19, which is further coupled to an electric motor 20. The two electric motors 20 for the inlet bridle rolls 12 are electrically connected to a motor driving circuit 21, which is further electrically connected to a speed controller 22. Similarly, the two electric motors 20 for the outlet bridle rolls 18 are electrically connected to a motor driving circuit 21 electrically connected to a speed controller 22. One of the electric motors 20 for the inlet bridle rolls 12 and one of the electric motors 20 for the outlet bridle rolls 18 are further electrically connected to respective pulse generators 23 for detecting the rotational speed thereof. A catenary sensor 25 is disposed immediately below the strip 11 between the coater 13 and the catenary oven 14 to detect the level of the strip 11 i.e., the distance between the catenary sensor 25 and the strip 11. A signal from the pulse generator 23 on the inlet side is inputted into a first differential amplifier 26 whereas that from the pulse generator 23 on the outlet side is inputted into a second differential amplifier 27. A signal from the catenary sensor 25 is inputted into a third differential amplifier 29 via an amplifier 28.

Furthermore, a speed setting device 30 and a level setting device 31 are provided which output a reference speed signal (a setting value) to the first and second differential amplifiers 26 and 27 and a level signal to the third differential amplifier 29, respectively. The second differential amplifier 27 also receives a correction signal required for correction of the speed of the outlet bridle rolls 18 via a level deviation amplifier 32. The correction signal is obtained on the basis of signals inputted into the third differential amplifier 29. The two signals inputted into the first differential amplifier 26 are converted into deviation signals, which are inputted into the speed controller 22 for the inlet bridle rolls 12 to feed-back control the rotational speed of the inlet bridle rolls 12. Similarly, the three signals inputted into the second differential amplifier 27 are converted into deviations signals, which are inputted into the speed controller 22 for the outlet bridle rolls 18 to feed-back control the rotational speed of the outlet bridle rolls 18. The speed of the outlet bridle rolls 18 are corrected on the basis of the feed-back signals from the catenary sensor 25.

Accordingly, even if the amount of sagging of the strip 11 varies in a catenary zone 24 due to, for example, a difference in peripheral speed (surface speed) between the inlet bridle rolls 12 and the outlet bridle rolls 18, the level of the strip 11 at the location of the catenary sensor 25 are so controlled as to be always substantially constant. More specifically, if the amount of sagging of the strip 11 increases, the peripheral speed of the outlet bridle rolls 18 is increased. In contrast, if the amount of sagging of the strip 11 reduces, the peripheral speed of the outlet bridle rolls 18 is reduced.

The above-described method employed in a conventional apparatus produces no problems in normal operations in which a strip 11 of a single material passes through the catenary zone 24. However, inconvenience occurs when a joint between two mutually joined strips having different sectional areas and/or specific gravities i.e., different unit weights passes through the catenary zone 24.

Supposing, for example, the situation immediately after a joint J where a strip 11*a* is followed by a strip 11*b* having a greater unit weight than the strip 11*a* has passed the catenary sensor 25, as shown in FIG. 2, the tension of the strips 11*a* and 11*b* rapidly increases to maintain the strip 11*b* having a greater unit weight at a level indicated by a setting value ($D_0$) at the location of the catenary sensor 25. In this case, since the tension of the strips 11*a* and 11*b* is large for the leading strip 11*a* having a smaller unit weight, the level of the strip 11*a* in the catenary zone 24 is unnecessarily raised, thus introducing the danger of the strip 11*a* touching the upper nozzles 15 in the oven 14.

On the other hand, supposing the situation immediately after a joint J where a strip 11*b* is followed by a strip 11*a* having a smaller unit weight than the strip 11*b* has passed the catenary sensor 25, as shown in FIG. 3, the tension of the strips 11*a* and 11*b* rapidly reduces to maintain the strip 11*a* having a smaller unit weight at a level indicated by a setting value ($D_0$) at the location of the catenary sensor 25. In this case, since the tension of the strips 11*a* and 11*b* is small for the leading strip 11*b* having a greater unit weight, the level of the strip 11*a* is unnecessarily lowered, thus introducing the danger of the strip 11*b* touching the lower nozzles 16 in the oven 14.

SUMMARY OF THE INVENTION

The present invention has been developed to overcome the above-described disadvantages.

It is accordingly an object of the present invention to provide a level control method capable of appropriately maintaining the levels of a series of mutually joined materials even when a joint between two adjoining strips having different unit weights passes through a catenary zone.

In accomplishing this and other objects, according to the present invention, whenever the joint travels a given length in the catenary zone, a plurality of optimum catenary curves are calculated with the position of the joint in the catenary zone as a parameter. Based upon a result of calculation obtained, a relationship indicative of the level of a material at the location of a catenary sensor is then calculated as a function of the position of the joint in the catenary zone. At this moment, the catenary sensor is used to detect the level of the material. Finally, the level of the material at the location of the catenary sensor is controlled with a value indicated by the above relationship as a target value. As a result, even when a joint between two adjoining materials having different unit weights passes through the catenary zone, the materials can travel in the catenary zone while being maintained appropriately in level.

Preferably, the levels of the materials are controlled by adjusting the rotational speed of bridle rolls provided upstream or downstream of the catenary zone in the direction of travel of the materials.

In another aspect of the present invention, a relationship indicative of the tension of the materials is calculated as a function of the position of the joint in the catenary zone, and the tension of the materials is controlled with a value indicated by the relationship as a target value.

BRIEF DESCRIPTION OF THE DRAWINGS

This and other objects and features of the present invention will become more apparent from the following description taken in conjunction with the preferred embodiment thereof with reference to the accompanying drawings, throughout which like parts are designated by like reference numerals, and wherein.

DETAILED DESCRIPTION OF THE PREFERRED EMBODIMENTS

Figure 4:
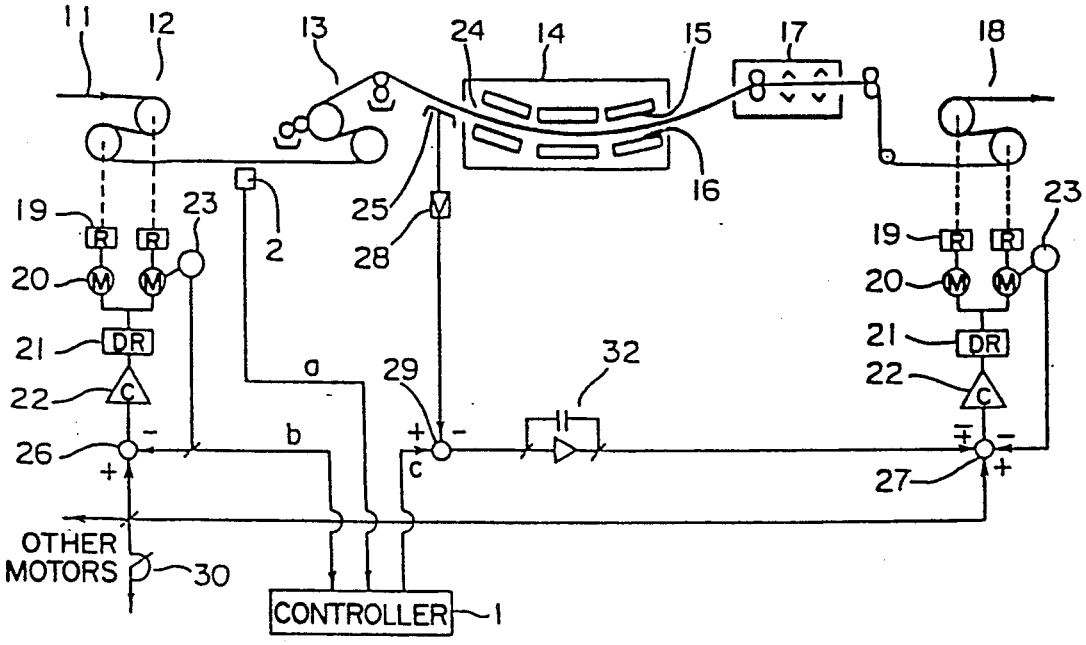
FIG. 4 is a schematic diagram of an apparatus to which a level control method according to a first embodiment of the present invention is applied.

Referring now to the drawings, there is schematically shown in FIG. 4 an apparatus to which a level control method according to a first embodiment of the present invention is applied. The apparatus of FIG. 4 is substantially the same as that of FIG. 1 except that the former is provided with an optimum level controller 1, a joint detector 2, and a control system associated therewith in place of a level setting device 31.

As shown in FIG. 4, the joint detector 2 for detecting a joint between two adjoining strips having different unit weights is disposed immediately below a strip 11 between inlet bridle rolls 12 and a coater 13. The optimum level controller 1 receives a rotational speed signal from a pulse generator 23 and a joint signal from the joint detector 2, and outputs, on the basis of these signals and a relationship in level calculated in a manner described later, a level setting signal indicative of the optimum level to a third differential amplifier 29.

Figure 1:
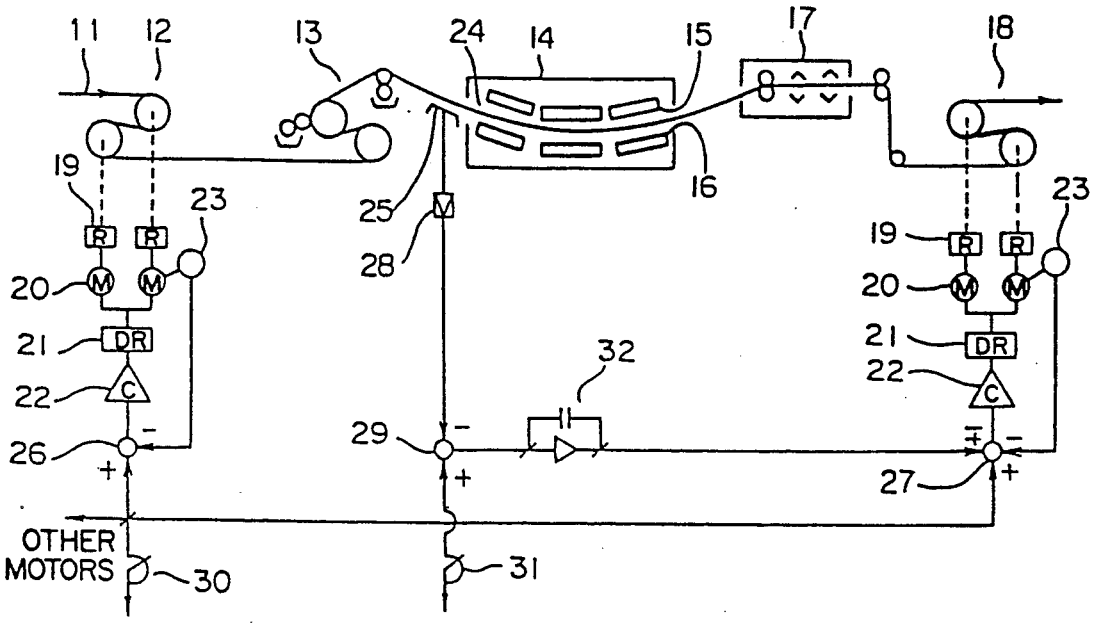
Fig. 1 PRIOR ART
FIG. 1 is a schematic diagram of an apparatus to which a conventional level control method is applied.
Figure 2:
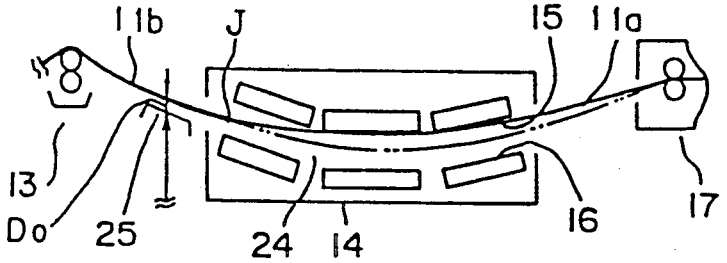
Fig. 2 PRIOR ART
FIG. 2 is a schematic view of a catenary oven provided in the apparatus of FIG. 1, indicating the situation immediately after a joint where a strip is followed by another strip having a greater unit weight has passed a catenary sensor.
Figure 3:
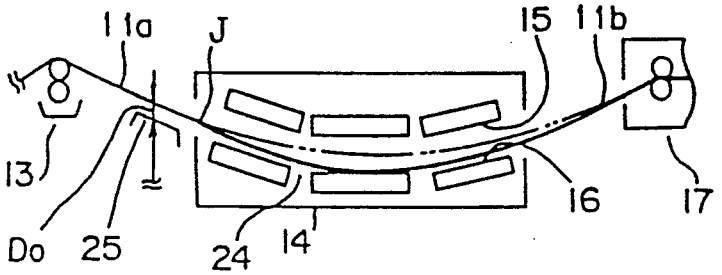
Fig. 3 PRIOR ART
FIG. 3 is a view similar to FIG. 2, indicating the situation immediately after a joint where a strip is followed by another strip having a smaller unit weight has passed the catenary sensor.

More specifically, the level setting signal to be inputted into the third differential amplifier 29 is a fixed signal from the level setting device 31 in the apparatus of FIG. 1 whereas the level setting signal is a variable signal from the optimum level controller 1 corresponding to the position of the joint in the catenary zone.

If there are provided other similar drive units for conveying strips, a reference speed signal from the speed setting device 30 is inputted into other motors.

Figure 5:
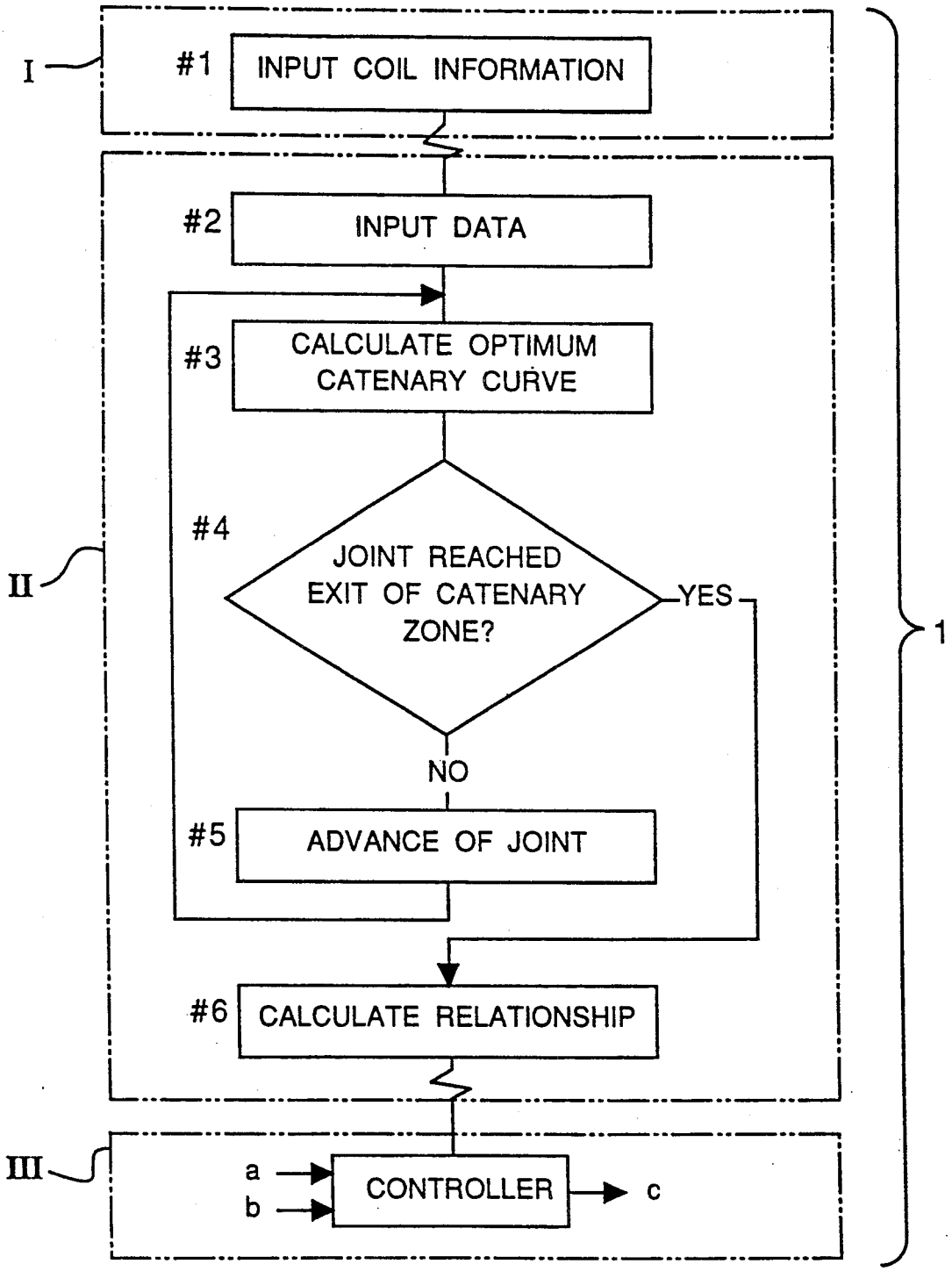
FIG. 5 is a flow-chart indicative of the procedure according to the first embodiment of the present invention.

FIG. 5 is a flow-chart indicative of the procedure according to a first embodiment of the present invention and is explained hereinafter along with a process in which the optimum level is calculated by the optimum level controller 1.

At step #1, a production schedule including coil information such as, for example, the order of processings and the thicknesses, specific gravities and widths of strips to be treated is initially inputted into a high level process-computer I. At step #2, data including the thicknesses, specific gravities and widths of the strips at the time a joint between two adjoining strips has reached an entrance of the catenary zone are inputted into a PLC (Programmable Logic Controller) or low level process computer II.

On the basis of the data inputted at step #2, an optimum catenary curve is calculated at step #3 by an algorithm, discussed later, in which the position of the joint in the catenary zone 24 is used as a parameter.

Step #4 determines whether the joint has reached an exit of the catenary zone 24. If NO at step #4, the procedure proceeds to step #5 where it is assumed that the joint travels a unit length. Thereafter, the procedure returns to step #3.

In contrast, if YES at step #4, the procedure proceeds to step #6 where a relationship indicative of the level of the strip at the location of a catenary sensor 25 is calculated as a function of the position of the joint in the catenary zone 24 by the use of, for example, a method of least squares on the basis of a plurality of optimum catenary curves, which are calculated in a loop from step #3 to step #5 with the position of the joint as a parameter This relationship is then outputted to an optimum level on-line controller III.

It is to be noted here that the operations from steps #1 to #6 are carried out in an off-line processing separated from the strip processing line. The relationship in level obtained at step #6 is calculated before the joint J enters the catenary zone 24 and is inputted into the optimum level on-line controller III, by which the catenary control is performed in an on-line processing.

It is further to be noted that signals (a), (b) and (c) inputted into or outputted from the optimum level on-line controller III correspond to those shown in FIG. 4.

Figure 6:
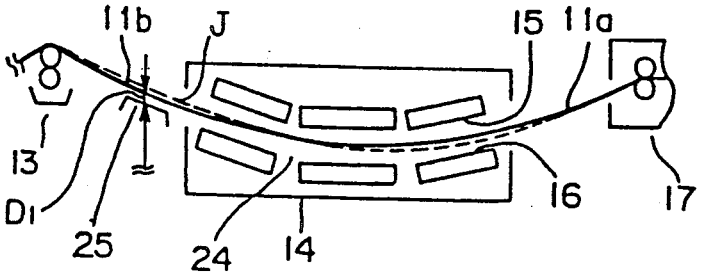
FIG. 6 is a schematic view of a catenary zone provided in the apparatus of FIG. 4.

When the joint enters the catenary zone 24, a level control signal outputted from the optimum level controller 1 momentarily changes, in accordance with the position of the joint in the catenary zone 24, a target output value (setting value) to be used in the level control from a fixed value for a single material before the joint J enters the catenary zone 24. For example, let the situation be assumed immediately after a joint J where a strip 11*a* is followed by another strip 11*b* having a greater unit weight has passed the catenary sensor 25, as shown in FIG. 6. In this case, a level $D_1$ of the strip 11*b* at the location of the catenary sensor 25 is gradually reduced with the advance of the joint J in the catenary zone 24 with respect to a level $D_0$ shown by a dotted line. The level $D_0$ is a level in the case where the strip located in the catenary zone 24 is of a single material. At a certain timing, the level $D_1$ of the strip 11*b* is conversely raised, and when the joint J leaves the catenary zone 24, the level $D_1$ of the strip 11*b* is restored to $D_0$. In this event, the level setting signal momentarily changing with time finds an optimum value in accordance with the relationship in level calculated in advance in an off-line processing. The situation in which a joint where a strip is followed by another strip having a smaller unit weight passes through the catenary zone 24 is substantially the same as that discussed above except that the direction of behavior of the level setting signal is reversed.

By doing so, the strips 11*a* and 11*b* are properly positioned in the catenary zone 24 in compliance with the position of the joint J so that no collisions of the strips 11*a* and 11*b* against upper or lower nozzles 15 or 16 would occur. As a result, the heat transfer efficiency can be raised by reducing the distance between the upper and lower nozzles 15 and 16, thus making it possible to reduce the length of the oven.

An example of algorithms, which can be performed at step #3, is explained hereinafter.

Figure 7:
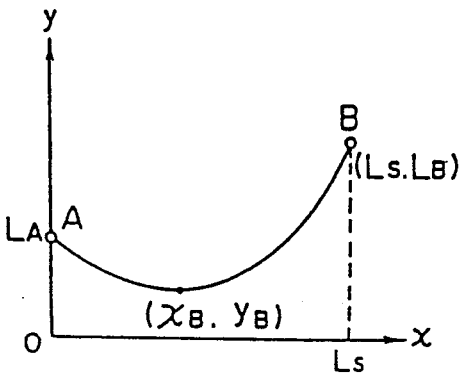
FIG. 7 is a graph indicative of a catenary curve for a strip of a single material.

When, as in FIG. 7, a strip of a single material is suspended from two points A and B and the co-ordinate of the lowermost point is $(x_B, y_B)$, a catenary curve thereof is expressed as follows:

$$y=a[\cosh\{(x-x_B)/a\}-1]+y_B \quad (1)$$

where a=H/W (a parameter of the catenary curve);

H: horizontal component of a tension of the strip; and

W: weight of a unit length of the strip.

Let the co-ordinates of both the supports A and B be known and be $(0, L_A)$ and $(L_S, L_B)$, respectively, we obtain from Equation (1)

$$L_A=a\{\cosh(-x_B/a)-1\}+y_B \quad (2)$$

$$L_B=a[\cosh\{(L_X-x_B)/a\}-1]+y_B \quad (3)$$

From these equations (2) and (3), we can find the unknowns $x_B$ and $y_B$, and thus, we can find, from Equation (1), a level y at an arbitrary point.

Figure 8:
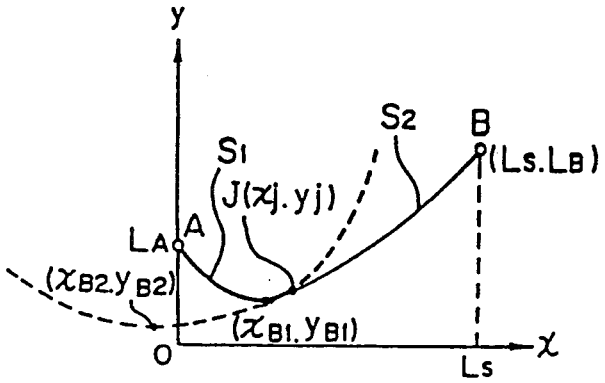
FIG. 8 is a graph indicative of a catenary curve at the time a joint between two mutually joined strips having different unit weights enters the catenary zone.

As shown in FIG. 8, when a joint J between two strips having different unit weights enters the catenary zone, catenary curves on the upstream side (left-hand side as viewed in the figure) and on the downstream side (right-hand side as viewed in the figure) of the joint J are expressed by an equation representative of a catenary curve of a strip S1 following the joint J and that representative of a catenary curve of a strip S2 followed by the joint J, respectively.

Let the co-ordinate of the lowermost point of the strip S1 be $(x_{B1}, y_{B1})$. When Equation (1) is applied to the catenary curve of the strip S1 crossing the support A having a co-ordinate $(0, L_A)$, we have $$L_A=a_1\{\cosh(-x_{B1}/a_1)-1\}+y_{B1} \quad (4)$$

where $a_1$ is a parameter of the catenary curve of the strip S1.

Similarly, let the co-ordinate of the lowermost point of the strip S2 be $(x_{B2}, Y_{B2})$, and we have $$L_B=a_2[\cosh\{(L_S-x_{B2})/a_2\}-1]+y_{B2} \quad (5)$$

where $a_2$ is a parameter of the catenary curve of the strip S2.

Let the co-ordinate of the joint J between the strips S1 and S2 be $(x_j, y_j)$. Since both the strips S1 and S2 cross the joint J, we obtain the following equations from Equation (1):

$$y_j=a_1[\cosh\{(x_j-x_{B1})/a_1\}-1]+y_{B1} \quad (6)$$

$$y_j=a_2[\cosh\{(x_j-x_{B2})/a_2\}-1]+y_{B2} \quad (7)$$

and thus $$a_1[\cosh\{(x_j-x_{B1})/a_1\}-1]+y_{B1}=a_2[\cosh\{(x_j-x_{B2})/a_2\}-1]+y_{B2} \quad (8)$$

Furthermore, since the gradient of the strip S1 and that of the strip S2 are equal to each other at the joint J, we obtain at the co-ordinate $(x_j, y_j)$ $$(dy_1/dx)=(dy_2/dx) \quad (9)$$

where $y_1$: function representative of the catenary curve of the strip S1; and $y_2$: function representative of the catenary curve of the strip S2.

From Equation (9), we have $$(x_j-x_{B2})/a_2=(x_j-x_{B1})/a_1 \quad (10).$$

From Equations (4), (5), (8) and (10), $x_{B1}$, $y_{B1}$, $x_{B2}$ and $y_{B2}$ can be represented by respective equations including $x_j$.

Similar to the strip of a single material, it follows by the calculation results that the catenary curve in the case where the joint J enters the catenary zone can be represented as follows using $x_j$ i.e., with the horizontal position of the joint in the catenary zone as a parameter:

$$y=a_i[\cosh\{(x-x_{Bi})/a\}-1]+y_{Bi} \quad (11)$$

where i=1 when $x<x_j$ and i=2 when $x\geqq x_j$.

Let the level of the strip of a single material represented by Equation (1) at various locations thereof be the reference level. Then, the deviation of the level of two mutually joined strips having different unit weights from the reference level is calculated by comparing the former with the latter. In this calculation, the level of the strips having different unit weights is represented by Equation (11) at the time the horizontal component of a supposed tension of the strips is rendered to be an initial value. Thereafter, it is determined whether the level of the strips is in the optimum state based upon the deviation calculated. For example, let the case where the maximum value in upward deviation from the reference level is equal to that in downward deviation from the reference level be the optimum state. If the strip is not regarded as being in the optimum state, the horizontal component of the supposed tension is increased or decreased a certain amount. Thereafter, the above calculation and determination are repeatedly carried out until the strip falls into the optimum state. Furthermore, upon calculation of a gap $D_1$ between the catenary sensor 25 and the strip under the conditions in which the tension of the strip exhibits an optimum value corresponding to the position of the strip in the optimum state, the optimum catenary curve is obtained at step #3 with the position of the joint as a parameter.

Figure 9:
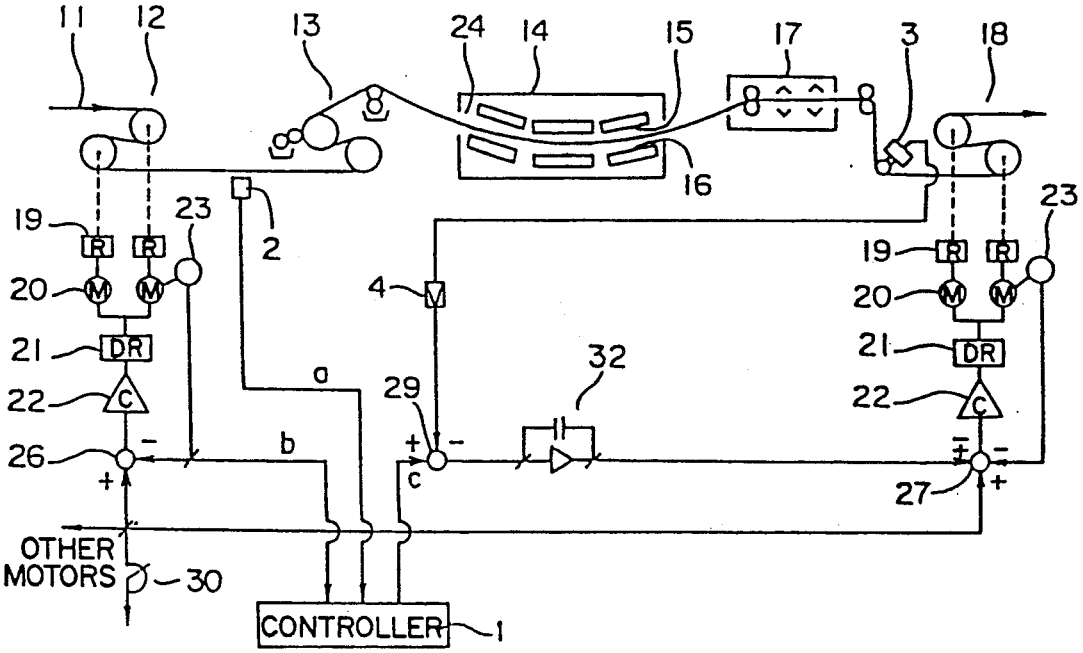
FIG. 9 is a diagram similar to FIG. 4, of an apparatus to which a level control method according to a second embodiment of the present invention is applied.

FIG. 9 schematically depicts an apparatus to which a level control method according to a second embodiment of the present invention is applied. The apparatus of FIG. 9 is substantially the same as that of FIG. 4 except that the former is provided with a tension detector 3 and an amplifier 4 in place of the catenary sensor 25 and the amplifier 28.

In the apparatus of FIG. 9, the tension of strips can be regulated by adding the tension detector 3 and the amplifier 4 for the control of the levels of the strips in the catenary zone.

More specifically, in the first embodiment, a relationship indicative of the level of a strip at the location of a catenary sensor is calculated as a function of the position of a joint at step #6 in the procedure of FIG. 5 whereas, in the second embodiment, a relationship indicative of the tension of strips in the catenary zone is calculated as a function of the position of the joint by the use of, for example, a method of least squares. The procedure of FIG. 5 except the above is applicable to the second embodiment.

In the second embodiment also, strips 11 are properly positioned in a catenary zone 24 in accordance with the position of a joint. Accordingly, the heat transfer efficiency can be raised by reducing the distance between upper and lower nozzles 15 and 16 without the possibility of accidental contact between the strips 11 and the upper and lower nozzles 15 and 16. As a result, not only the length of an oven can be reduced, but also the optimization in nozzle mechanism can be facilitated, thus complying with a recent trend of increase in the kind of materials to be treated.

It is to be noted here that in the above-described embodiments, although the levels of strips are controlled by changing the rotational speed of outlet bridle rolls 18, they can be controlled, for example, by changing the rotational speed of inlet bridle rolls 12.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A level control method of controlling levels of a series of mutually joined materials when the materials pass through a catenary zone, said method comprising the steps of:

(a) calculating, whenever a joint between two adjoining materials travels a given length in the catenary zone, a plurality of optimum catenary curves with a position of said joint in the catenary zone as a parameter;

(b) calculating, based upon a result of calculation obtained at step (a), a relationship indicative of a level of a material at a location of a catenary sensor as a function of the position of said joint in the catenary zone, said catenary sensor being used to detect the level of the material; and (c) controlling the level of the material at the location of the catenary sensor with a value indicated by said relationship as a target value, whereby, even when a joint between two adjoining materials having different unit weights passes through the catenary zone, the materials can travel in the catenary zone while being maintained appropriately in level.

2. The method according to claim 1, wherein the levels of the materials are controlled by changing a rotational speed of bridle rolls provided upstream of the catenary zone in a direction of travel of the materials.

3. The method according to claim 1, wherein the levels of the materials are controlled by changing a rotational speed of bridle rolls provided downstream of the catenary zone in a direction of travel of the materials.

4. A level control method of controlling levels of a series of mutually joined materials when the materials pass through a catenary zone, said method comprising the steps of:

(a) calculating, whenever a joint between two adjoining materials travel a given length in the catenary zone, a plurality of optimum catenary curves with a position of said joint in the catenary zone as a parameter;

(b) calculating, based upon a result of calculation obtained at step (a), a relationship indicative of a tension of the materials as a function of the position of said joint in the catenary zone; and (c) controlling the tension of the materials with a value indicated by said relationship as a target value, whereby, even when a joint between two adjoining materials having different unit weights passes through the catenary zone, the materials can travel in the catenary zone while being maintained appropriately in level.

5. The method according to claim 4, wherein the levels of the materials are controlled by changing a rotational speed of bridle rolls provided upstream of the catenary zone in a direction of travel of the materials.

6. The method according to claim 4, wherein the levels of the materials are controlled by changing a rotational speed of bridle rolls provided downstream of the catenary zone in a direction of travel of the materials.

* * * * *